US009868223B2

(12) United States Patent
Shiokawa

(10) Patent No.: US 9,868,223 B2
(45) Date of Patent: Jan. 16, 2018

(54) PAPER PROCESSING APPARATUS AND IMAGE FORMING SYSTEM

(71) Applicant: Konica Minolta, Inc., Tokyo (JP)

(72) Inventor: Tsuyoshi Shiokawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 195 days.

(21) Appl. No.: 14/739,003

(22) Filed: Jun. 15, 2015

(65) Prior Publication Data

US 2015/0360382 A1 Dec. 17, 2015

(30) Foreign Application Priority Data

Jun. 17, 2014 (JP) ..... 2014-124347

(51) Int. Cl.
*B26D 7/18* (2006.01)
*B26D 7/02* (2006.01)
*B26D 1/08* (2006.01)

(52) U.S. Cl.
CPC ..... *B26D 7/18* (2013.01); *B26D 1/085* (2013.01); *B26D 7/02* (2013.01); *Y10T 83/202* (2015.04)

(58) Field of Classification Search
CPC ... B65H 5/04; B65H 5/10; B65H 5/14; B65H 2301/4224; B65H 2301/515; B65H 7/20;
(Continued)

(56) References Cited

U.S. PATENT DOCUMENTS 4,445,409 A * 5/1984 Mohr ..... B26D 7/18 83/157
6,601,490 B1 * 8/2003 Gross ..... B26D 7/015 83/27

(Continued)

FOREIGN PATENT DOCUMENTS

EP 1842633 A1 * 10/2007
JP 2005-169598 A * 6/2005

(Continued)

OTHER PUBLICATIONS

Notification of Reasons for Reasons for Refusal dated Mar. 29, 2016; Patent Application No. 2014-124347; total of 2 pages; English translation of Notification of Reasons for Reasons for Refusal; total of 3 pages: Grand Total of 5 pages.

*Primary Examiner* — Leslie A Nicholson, III
(74) *Attorney, Agent, or Firm* — Lucas & Mercanti, LLP

(57) ABSTRACT

A paper processing apparatus includes a pressing member which approaches and presses a paper bundle inserted into a space formed between the pressing member and a supporting member for supporting a paper, a cutting blade which cuts an end portion of the paper bundle pressed by the pressing member, a removal member having a front end portion which removes cutting waste of the paper bundle, a removal member which has a front end portion which reaches a position at which the paper bundle is pressed by the pressing member, and removes cutting waste of the paper bundle by the front end portion, and a control unit. The control unit controls the removal member such that the front end portion is positioned at a retreat position apart from the pressing member during an approaching operation in which the pressing member is approaching the paper bundle.

14 Claims, 12 Drawing Sheets

(58) Field of Classification Search
CPC . B26D 1/085; B26D 7/02; B26D 7/18; B26D 2007/1809
USPC ..... 270/32, 37, 52.18
See application file for complete search history.

(56) References Cited

U.S. PATENT DOCUMENTS

| | | | | |
|---|---|---|---|---|
| 7,854,581 | B2 * | 12/2010 | Kubo | B42C 19/02 270/58.07 |
| 7,987,751 | B2 * | 8/2011 | Shiokawa | G03G 15/6523 222/527 |
| 8,894,056 | B2 * | 11/2014 | Oshima | B65H 39/00 270/32 |
| 2010/0329768 | A1 | 12/2010 | Watanabe et al. | |

FOREIGN PATENT DOCUMENTS

| | | | | |
|---|---|---|---|---|
| JP | 2007061967 | A | | 3/2007 |
| JP | 2007-326200 | A | * | 12/2007 |
| JP | 2009-279692 | A | * | 12/2009 |
| JP | 2011011272 | A | | 1/2011 |

* cited by examiner

PAPER PROCESSING APPARATUS AND IMAGE FORMING SYSTEM

CROSS-REFERENCE TO RELATED APPLICATION

This application is based on Japanese Patent Application No. 2014-124347 filed on Jun. 17, 2014, the contents of which are incorporated herein by reference.

BACKGROUND

1. Technical Field

The present invention relates to a paper processing apparatus and an image forming system.

2. Description of Related Arts

An image forming system having an image forming apparatus such as a copy machine and a printer has a paper processing apparatus for cutting a paper bundle as a post-processing apparatus.

As a paper processing apparatus for cutting a paper bundle, there has been known a paper processing apparatus having a pressing member for pressing the paper bundle, a cutting blade for cutting an end portion of the paper bundle pressed by the pressing member, and a removal member for removing cutting waste of the paper bundle. For example, a sheet cutting apparatus disclosed in Japanese unexamined Patent application publication No. 2007-61967 is configured to have a rotating brush 185, and to make the rotating brush 185 which is rotated, contact with a blade receiving surface 150a, so that cutting waste cut by a cutting blade 120a and attached to the blade receiving surface 150a is removed and falls down (paragraph 0047, FIG. 10 (a)).

In such a paper processing apparatus, in order to more securely remove cutting waste, the removal member is preferably configured not only to reach a position at which the removal member can make contact with paper waste at a minimum but to reach the vicinity of the position. However, in such a case configured as described above, there is a case in which the removal member is damaged as described below.

That is, in the case in which the removal member reaches a position at which the paper bundle is pressed by the pressing member, when the pressing member moves in a direction in which the paper bundle is pressed, There is a possibility that the removal member is caught between the paper bundle and the pressing member. Therefore, when the removal member is caught between the paper bundle and the pressing member, there is a case in which the removal member is damaged. Moreover, there is a case in which the pressing member is disposed in the vicinity of a cutting blade, in order to prevent position shift or torsion of the paper bundle from occurring at the time of cutting. Therefore, there is a case in which the removal member is further damaged by the cutting blade when the cutting blade performs the cutting of the paper bundle in a state in which the removal member has been caught between the paper bundle and the pressing member.

SUMMARY

The present invention is made in order to solve the abovementioned problems associated with the related art, and aims to provide a paper processing apparatus and an image forming system which can securely remove cutting waste of a paper bundle and prevent a removal member from being damaged.

To achieve at least one of the abovementioned objects, a paper processing apparatus reflecting one aspect of the present invention comprises: a supporting member for supporting a paper; a pressing member which is disposed to form a space between the pressing member and the supporting member, and approaches and presses a paper bundle inserted into the space; a cutting blade which cuts an end portion of the paper bundle pressed by the pressing member; a removal member having a front end portion which removes cutting waste of the paper bundle; a removal member which has a front end portion which reaches a position at which the paper bundle is pressed by the pressing member, and removes cutting waste of the paper bundle by the front end portion; and a control unit which controls at least the removal member, wherein the control unit controls the removal member such that the front end portion is positioned at a retreat position apart from the pressing member during an approaching operation in which the pressing member is approaching the paper bundle.

It is preferable that the removal member is a paddle which is rotated.

It is preferable that the control unit controls the removal member to stop its operating at the retreat position during the approaching operation in which the pressing member approaches the paper bundle, and controls the removal member to start an operation for removing the cutting waste of the paper bundle after completion of the approaching operation of the pressing member.

It is preferable that the control unit controls the removal member to start an operation for removing the cutting waste of the paper bundle after completion of the approaching operation of the pressing member and before cutting of the end portion of the paper bundle by the cutting blade.

It is preferable that the control unit controls the removal member such that the cutting waste of the paper bundle is repeatedly removed.

It is preferable that the control unit controls the removal member to perform an operation for removing the cutting waste of the paper bundle during a period from a time before insertion of the paper bundle into the space to a time before start of the approaching operation of the pressing member.

It is preferable that a detection unit for detecting a position of the removal member is further provided and the control unit controls the removal member to be positioned at the retreat position based on the detected position.

It is preferable that a component part disposed in a vicinity of the removal member is further provided, and the retreat position is set such that the removal member does not interfere with the component part when the removal member is positioned at the retreat position.

It is preferable that the paper bundle is saddle-stitched, and the end portion of the paper bundle, which is cut by the cutting blade, is an edge of the paper bundle.

The objects, features, and characteristics of this invention other than those set forth above will become apparent from the description given herein below with reference to preferred embodiments illustrated in the accompanying drawings.

DETAILED DESCRIPTION

Hereinafter, an embodiment of the present invention will be described below with reference to the drawings. In addition, the dimension ratio of each drawing is exaggerated for the sake of description, and may differ from an actual ratio.

Figure 1:
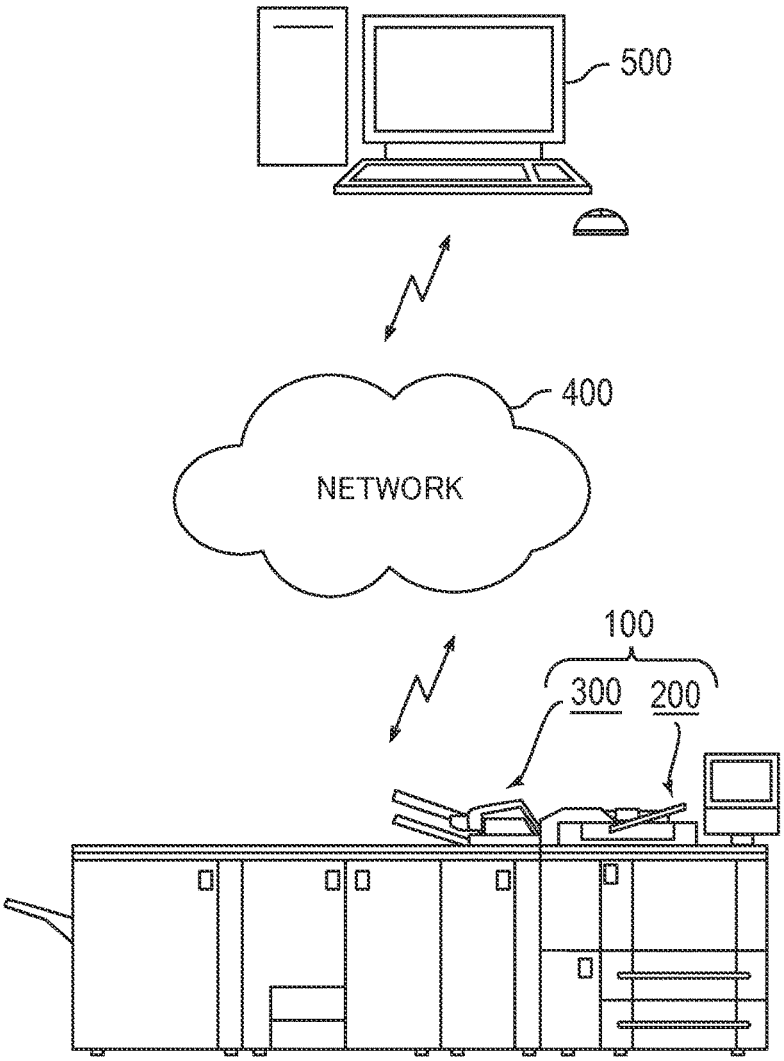
FIG. 1 is a schematic view of assistance in explaining an image forming system according to an embodiment of the present invention.

FIG. 1 is a schematic view of assistance in explaining an image forming system according to an embodiment of the present invention.

An image forming system 100 according to the present embodiment includes an image forming apparatus 200 and a paper post-processing apparatus 300, and is configured to be able to communicate with a computer device 500 via a network 400.

The computer device 500 is a terminal used for creating a print job including print data, and transmit the print job to the image forming system 100. The print data, for example, is data described in a PDL (Page Description Language) language form such as PostScript (registered trademark) and PCL (Printer Control Language), and includes print setting information and image information. The print setting information, for example, includes print setting of a finish size, etc., and the content of post-processing setting.

The image forming apparatus 200 constitutes a main unit of the image forming system 100, and is used for generating image data from the print data included in the received print job, and form (print) an image on a paper.

The paper post-processing apparatus 300 is a paper processing apparatus used for performing post-processing on a paper bundle which is formed by stacking a plurality of papers on which an image is formed by the image forming apparatus 200. The post-processing, for example, is saddle stitch bookbinding processing and edge cutting processing.

The network 400 includes various networks such as a LAN (Local Area Network) that connects computers or network devices to one another by a standard like Ethernet (registered trademark), Token Ring, FDDI (Fiber-Distributed Data Interface), etc., a WAN (Wide Area Network) that connects LANs to one another by dedicated lines, the Internet, and a combination thereof. A network protocol, for example, is TCP/IP (Transmission Control Protocol/Internet Protocol).

Next, the image forming apparatus 200 will be described in detail.

Figure 2:
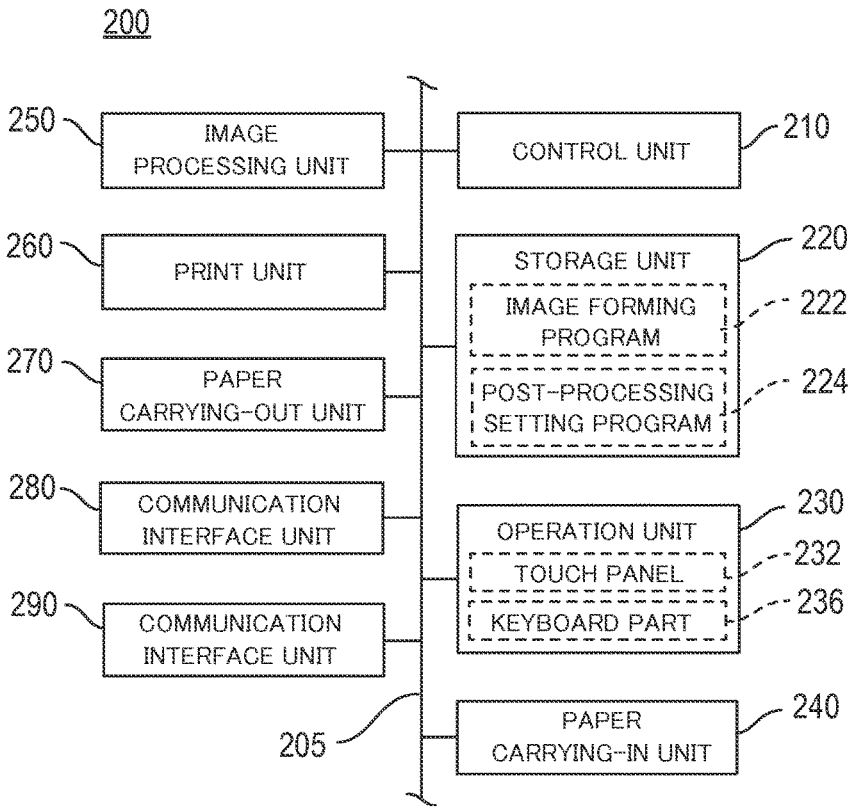
FIG. 2 is a block diagram of assistance in explaining an image forming apparatus shown in FIG. 1.

FIG. 2 is a block diagram of assistance in explaining the image forming apparatus shown in FIG. 1.

As shown in FIG. 2, the image forming apparatus 200 has a control unit 210, a storage unit 220, an operation unit 230, a paper carrying-in unit 240, an image processing unit 250, a print unit 260, a paper carrying-out unit 270, and communication interface units 280 and 290, and these are communicably connected to one another by a bus 205.

The control unit 210 is a control circuit including a microprocessor, etc., which perform control of each element and various types of operation processing according to programs, and each function of the image forming apparatus 200 is exhibited when the control unit 210 executes programs corresponding to each function.

The storage unit 220 is used for storing various programs and various pieces of data, and is configured by an appropriate combination of ROM (Read Only Memory), RAM (Random Access Memory), a rewritable nonvolatile memory (e.g. a flash memory), a hard disk drive device, etc. For example, a program stored in the ROM is read by the control unit 210 according to necessity, and is executed using the RAM as a work area for temporarily storing the program and data required for executing the program.

The stored program, for example, is OS (Operating System), an image forming program 222, and a post-processing setting program 224.

The image forming program 222 is used for controlling the image processing unit 250 to form (print) an image on a paper supplied from the paper carrying-in unit 240. The post-processing setting program 224 is used for transmitting setting (post-processing setting) data or control data of the paper post-processing apparatus 300 in the case of performing post-processing on a plurality of papers on which an image has been formed, to the paper post-processing apparatus 300. The post-processing setting data includes settings such as the size of a paper on which an image has been formed, a finish size (external shape data), the number of staple needles, a stapling position of the staple needle, an edge cutting position, for example.

The operation unit 230 serves as a display unit and an input unit, and has a touch panel 232 and a keyboard part 236.

The touch panel 232 has a display part and a sensor for touch operation detection, and is configured to display a device configuration, a progress status of a print job, an occurrence status of an error, currently changeable setting, an alarm for calling a user's intention, etc., and to input an instruction through the position of a finger or a pen touched to the display part. The touch panel type is not particularly limited, and an electrostatic capacity type or a resistance film type can be employed. The keyboard part 236 has a plurality of keys including a selection key for designating a paper size, a numeric keypad for setting the number of copies, etc., a start key for instructing the start of an operation, a stop key for instructing the stop of an operation, a keyboard for inputting characters, etc.

The paper carrying-in unit 240 has a plurality of paper feeding trays, holds various papers inserted in advance by hands of a user, and is used for taking out papers instructed by the control unit 210 from the paper feeding trays, and to convey the papers toward the image processing unit 250.

The image processing unit 250 is used for performing RIP (Raster Image Processing) on print data, and to generate raster image data to be used in the print unit 260.

The print unit 260 is an image forming unit that forms a toner image on a paper serving as a recording medium by using an electrophotographic process including charging, exposure, developing, transfer, and fixing processes, and an image is formed on a paper conveyed from the paper carrying-in unit 240 by using the data (the raster image data) from the image processing unit 250. The image processing method is not limited to the electrophotographic method, and an impact method, a thermal transfer method, an inkjet method, etc., can also be employed.

The paper carrying-out unit 270 is used for carrying out the paper, on which the image has been formed, toward the paper post-processing apparatus 300.

The communication interface unit 280 is a communication unit including an expansion device (a LAN board) for adding a communication function via the network 400 to the image forming system 100, and is used for transmitting/receiving data to/from the computer device 500 belonging to the network 400.

The communication interface unit 290 is used for transmitting/receiving data to/from the paper post-processing apparatus 300. The data is control data or post-processing setting data required in order to perform a post-processing job (a bookbinding job and a cutting job) in the paper post-processing apparatus 300.

Next, the paper post-processing apparatus 300 will be described in detail.

Figure 3:
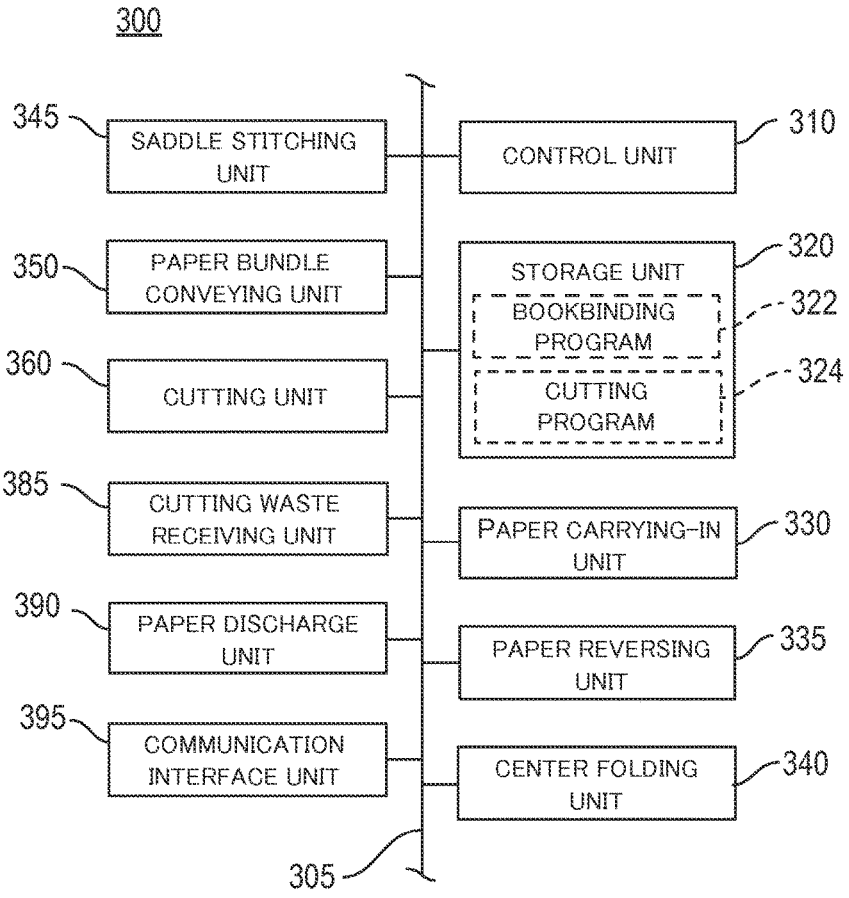
FIG. 3 is a block diagram of assistance in explaining a paper post-processing apparatus shown in FIG. 1.
Figure 4:
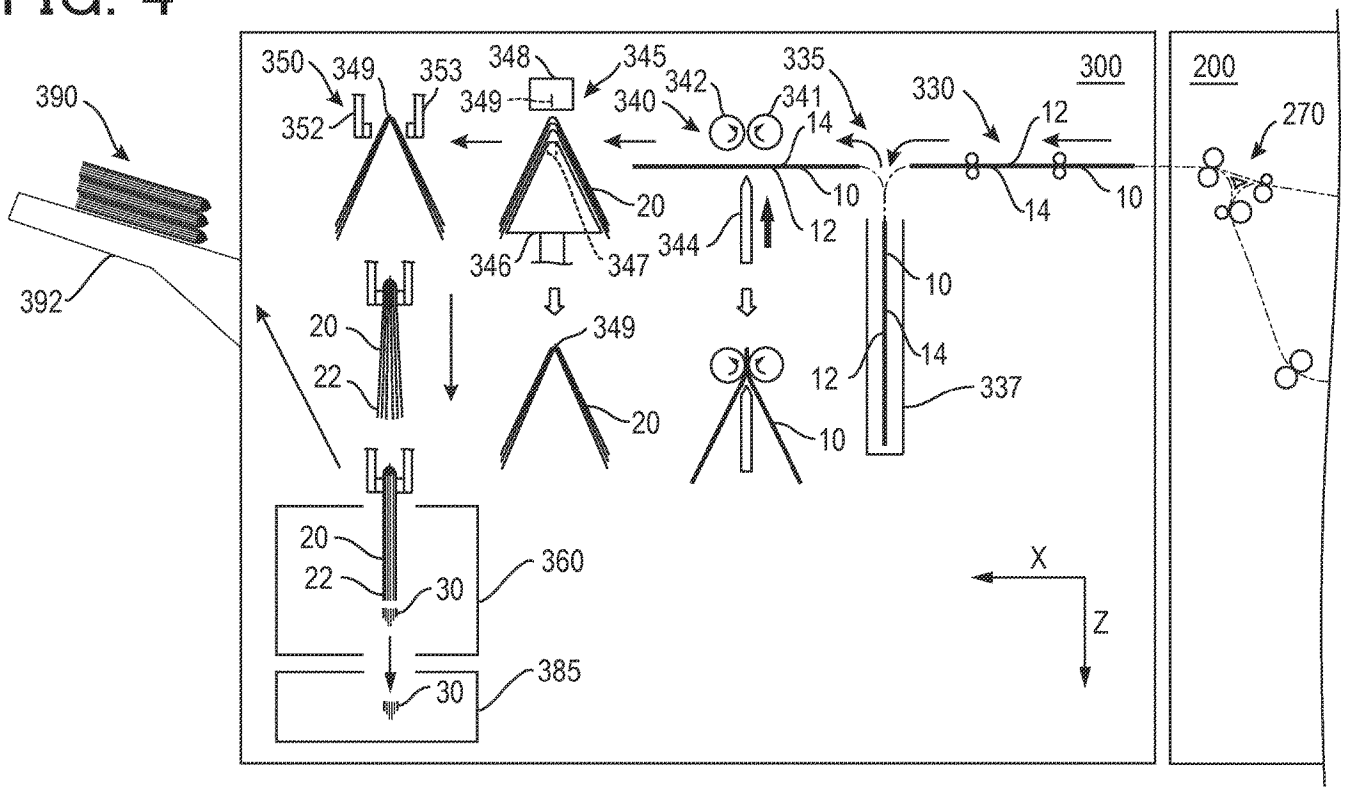
FIG. 4 is a schematic view of assistance in explaining the paper post-processing apparatus shown in FIG. 1.

FIG. 3 and FIG. 4 are a block diagram and a schematic view of assistance in explaining the paper post-processing apparatus shown in FIG. 1.

As shown in FIG. 3, the paper post-processing apparatus 300 has a control unit 310, a storage unit 320, a paper carrying-in unit 330, a paper reversing unit 335, a center folding unit 340, a saddle stitching unit 345, a paper bundle conveying unit 350, a cutting unit 360, a cutting waste receiving unit 385, a paper discharge unit 390, and a communication interface unit 395, and these are communicably connected to one another by a bus 305.

The control unit 310 is a control circuit including a microprocessor, etc., which perform control of each element and various types of operation processing according to programs, and each function of the paper post-processing apparatus 300 is exhibited when the control unit 310 executes programs corresponding to each function according to an instruction from the control unit 210 of the image forming apparatus 200.

The storage unit 320 is used for storing various programs and various pieces of data, and is configured by an appropriate combination of ROM, RAM, a rewritable nonvolatile memory, a hard disk drive device, etc.

The stored program, for example, is a bookbinding program 322 and a cutting program 324 which are started by an instruction from the post-processing setting program 224. The bookbinding program 322 is used for controlling each element of the paper post-processing apparatus 300, to form a paper bundle 20 by stacking a plurality of papers 10 on which an image has been formed, and to perform a saddle stitch bookbinding processing on the paper bundle by using a staple needle. The cutting program 324 is used for cutting an end portion 22 of the paper bundle 20 subjected to the saddle stitch bookbinding processing. In addition, in the present embodiment, the end portion 22 of the paper bundle 20 is an edge which is a free end opposite to a saddle stitching portion of the paper bundle 20. The cutting program 324 includes a determination control part and a retreat control part. The determination control part determines whether a pressing member 363 is performing the approaching operation for approaching the paper bundle 20. The retreat control part controls the removal member 370 such that the front end portion 371A is positioned at a retreat position apart from the pressing member 363 when the determination control part determines that the pressing member 363 is performing the approaching operation for approaching the paper bundle 20.

As shown in FIG. 4, the paper carrying-in unit 330 is used for receiving papers from the paper carrying-out unit 270 of the image forming apparatus 200, and to convey the papers toward the paper reversing unit 335.

The paper reversing unit 335 has a waiting part 337 which stops the entire paper 10 once in a state along a vertical direction Z, and is used for reversing (turning over) the paper 10 from the paper carrying-in unit 330, and for example, to allow an image-formed surface to be positioned inward when the center is folded.

In detail, as shown in FIG. 4, the paper 10 is moved down in the vertical direction Z perpendicular to a conveyance direction X, and the entire paper 10 is positioned in the waiting part 337. Thereafter, the paper 10 is moved up in the vertical direction Z and conveyed to a downstream side of the conveyance direction X. In this way, a first surface 12 positioned on the surface and a second surface 14 positioned on the rear surface of the paper 10 before the paper 10 is put into the paper reversing unit 335 are reversed (turned over) in the paper reversing unit 335, and are positioned on the rear surface and the surface of the paper 10 at the time point at which the paper 10 is carried out from the paper reversing unit 335.

The center folding unit 340 has a pair of rollers 341 and 342 rotating in opposite directions, and a protruding member 344 positioned between the rollers 341 and 342, and is used for giving a fold to the paper 10 and fold the paper 10 in the center. In detail, the center portion of the paper 10 in the conveyance direction X is positioned below the rollers 341 and 342, and then the protruding member 344 presses the paper 10 from the rear surface side of the paper 10 toward between the rollers 341 and 342. In this way, the center portion of the paper 10 is nipped by the rollers 341 and 342 in a state in which the center portion of the paper 10 has been supported by the protruding member 344, and the fold is formed, so that the paper 10 is folded in the center.

The saddle stitching unit 345 has a saddle stand part 346, a needle receiving mechanism 347, and a stapling mechanism part 348 with a staple needle 349, and is used for saddle-stitching the paper bundle 20 (a stacked body of a plurality of papers 10 which have been folded in the center) placed on the saddle stand part 346. In detail, the paper bundle 20 is disposed on the saddle stand part 346 having two guide surfaces perpendicular to each other. Then, in a state in which the fold of the paper bundle 20 is elastically supported by the needle receiving mechanism 347 disposed in the vicinity of an apex of the saddle stand part 346, the needle receiving mechanism 347 is moved up toward the stapling mechanism part 348 disposed above the fold of the paper bundle 20. In this way, the fold of the paper bundle 20 is pressed by (abuts) the stapling mechanism part 348 and is saddle-stitched by the staple needle 349 held by the stapling mechanism part 348.

The paper bundle conveying unit 350 has a pair of arms 352 and 353 configured to freely approach each other and separate from each other, and is used for conveying and holding (supporting) the saddle-stitched paper bundle 20. In detail, in a state in which a back cover part of the saddle-stitched paper bundle 20 is nipped by the arms 352 and 353, the arms 352 and 353 convey the saddle-stitched paper bundle 20 from the saddle stitching unit 345 to the cutting unit 360, and then support (hold) the saddle-stitched paper bundle 20 during cutting in the cutting unit 360 and convey the saddle-stitched paper bundle 20 to the paper discharge unit 390 after the cutting.

The cutting unit 360 is used for cutting an end portion (an edge) 22 of the saddle-stitched paper bundle 20. In this way, since the edge becoming uneven by the number of papers 10 constituting the paper bundle 20 is cut, the external appearance of the paper bundle 20 is improved. A detailed configuration of the cutting unit 360 will be described later with reference to FIG. 5, etc.

The cutting waste receiving unit 385 is used for receiving cutting waste 30 cut from the saddle-stitched paper bundle 20 in the cutting unit 360. The cutting waste receiving unit 385 is configured to be disposed directly under the cutting unit 360, and to receive the cutting waste 30 falling by its own weight.

The paper discharge unit 390 has a paper discharge tray 392 disposed on the outside of the paper post-processing apparatus 300, and is used for discharging the paper bundle 20 (the saddle-stitched paper bundle) conveyed from the cutting unit 360.

The communication interface unit 395 is used for transmitting/receiving data to/from the image forming apparatus 200. The data is control data or post-processing setting data required in order to perform a post-processing job (a bookbinding job and a cutting job) in the paper post-processing apparatus 300.

The paper post-processing apparatus 300 is not limited to the aforementioned configuration, and for example, a square fold processing unit, which performs square fold processing (square back processing) for shaping the back cover part of a stitched paper bundle, a top and bottom cutting processing unit for cutting the top and bottom of a saddle-stitched paper bundle, a Z-folding processing unit for bending a paper twice in a Z shape when viewed from an extension line direction of a fold, a punching processing unit for punching a hole for filing in an end portion of a paper, a side stitching processing unit for binding a portion of about 5 mm from an end of a paper bundle as a binding margin by a staple needle, etc., can also be appropriately incorporated.

Next, the cutting unit 360 will be described in detail.

Figure 5:
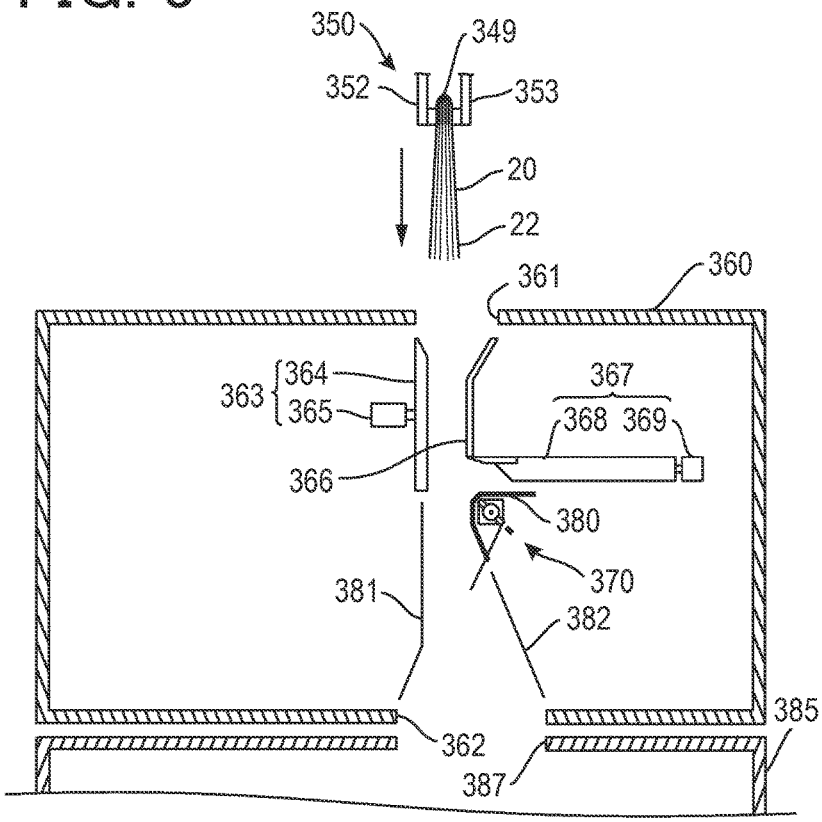
FIG. 5 is a schematic view of assistance in explaining a cutting unit shown in FIG. 3 and FIG. 4.
Figure 6:
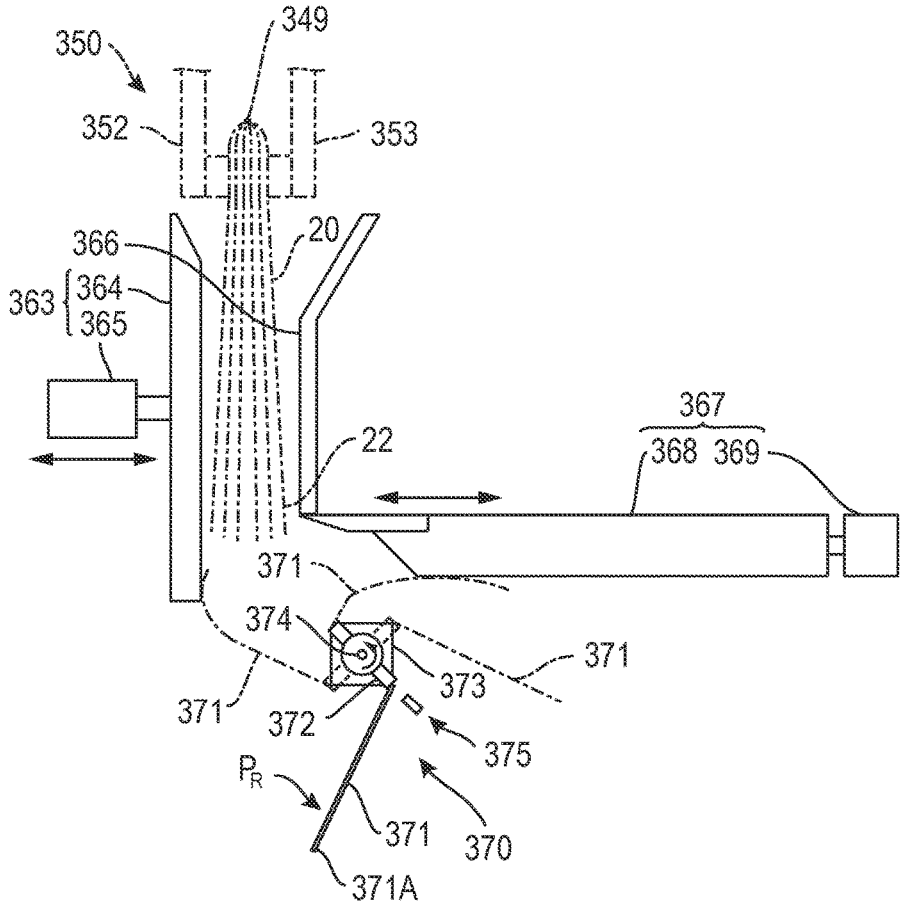
FIG. 6 is a schematic view of assistance in explaining main elements of the cutting unit.
Figure 7:
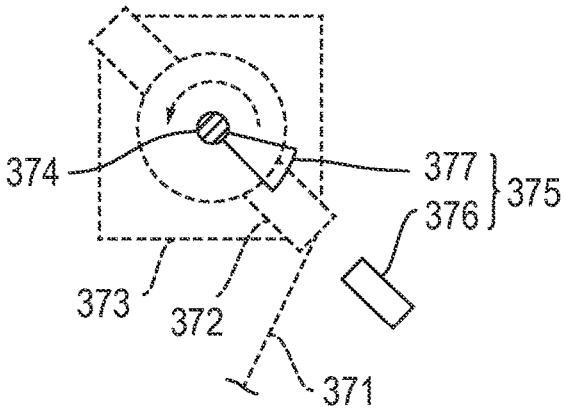
FIG. 7 is a schematic view of assistance in explaining rotational position control of a removal member shown in FIG. 6.

FIG. 5 is a schematic view of assistance in explaining the cutting unit 360 shown in FIGS. 3 and 4, FIG. 6 is a schematic view of assistance in explaining main elements of the cutting unit 360, and FIG. 7 is a schematic view of assistance in explaining the rotational position control of the removal member 370 shown in FIG. 6.

As shown in FIG. 5, the cutting unit 360 has a paper bundle insertion port 361, a cutting waste discharge port 362, a pressing member 363, a support member 366, a cutting mechanism 367, a removal member 370, and guide members 380, 381 and 382.

The paper bundle insertion port 361 is an opening for inserting the paper bundle 20 conveyed by the arms 352 and 353 of the paper bundle conveying unit 350 into an inner side of the cutting unit 360.

The cutting waste discharge port 362 is aligned with a cutting waste receiving port 387 of the cutting waste receiving unit 385, and is used for receiving the cutting waste 30 (see FIG. 4) generated by cutting the end portion 22 of the paper bundle 20 in the cutting waste receiving unit 385.

The pressing member 363 has the receiving block 364 and the driving unit 365. The pressing member 363 has a function of approaching and pressing the inserted paper bundle 20.

The receiving block 364 is a blade receiving part of the cutting blade 368 which is configured to freely approach and separate from the inserted paper bundle 20.

The driving unit 365 is used for driving and positioning the receiving block 364 at a waiting position, a paper bundle receiving position $P_1$, and a paper bundle pressing position $P_P$. The waiting position is a home position at which the receiving block 364 waits when there is no post-processing job (no cutting job). The paper bundle receiving position $P_1$ is a position when the paper bundle 20 is received, and is set such that a space for permitting the insertion of the paper bundle 20 is generated between the receiving block 364 and the support member 366.

The paper bundle pressing position $P_P$ is a position at which the receiving block 364 abuts the paper bundle 20 to apply pressing force. The pressing force is set such that position shift or torsion of the paper bundle 20 (or papers constituting the paper bundle 20) is prevented from occurring at the time of cutting. In addition, when the receiving block 364 abuts the paper bundle 20 to apply pressing force, the rear surface of the paper bundle 20 is supported by the fixed type support member 366.

The support member 366 is configured to be fixed, to be aligned with the receiving block 364, and to freely clamp the paper bundle 20, which is inserted into a space formed between the support member 366 and the receiving block 364, in cooperation with the pressing member 363.

The configurations of the pressing member 363 and the receiving block 364 are not limited to the aforementioned configurations. For example, it is possible that the receiving block 364 is configured to be fixed, and the support member 366 is configured to freely approach and separate from the receiving block 364. In this case, the support member 366 functions as the pressing member. Furthermore, as circumstances demand, the pressing member 363 and the support member 366 may also be configured to function as the pressing member by being configured so as to freely approach each other and separate from each other (to be movable).

The cutting mechanism 367 has the cutting blade 368 and a driving unit 369.

The cutting blade 368 is used for cutting the end portion 22 of the paper bundle 20 pressed by the pressing member 363 at the paper bundle pressing position $P_P$. The driving unit 369 is used for driving the cutting blade 368 to generate shear force for cutting the end portion 22 of the paper bundle 20. In addition, from the standpoint of cutting the end portion 22 of the paper bundle 20 by relatively small driving force, it is preferable to allow the cutting blade 368 to abut the end portion 22 of the paper bundle 20 while sliding the cutting blade 368 in a direction perpendicular to both the conveyance direction X and the vertical direction Z.

As shown in FIG. 6, the removal member 370 has a paddle 371, a base 372, a driving unit 373, and a detection unit 375 (see FIG. 7). The removal member 370 has a function of removing cutting waste.

The paddle 371 has a front end portion 371A which may reach a position (the paper bundle pressing position $P_P$) at which the pressing member 363 presses the paper bundle 20. Consequently, the paddle 371 can securely remove cutting waste attached to the receiving block 364, with the front end portion 371A. The paddle 371 is fixed to the base 372, and the base 372 is configured to freely rotate about a shaft 374. The driving unit 373 is, for example, composed of a motor which rotates the shaft 374, and can rotate the paddle 371.

The paddle 371 is made of an elastic (flexible) thin plate and is a thin plate made of polyurethane of about 1 mm, for example. In addition, it is also permissible to install a plurality of the removal members 370. Furthermore, a plurality of paddles 371 may also be fixed to the base 372.

The detection unit 375 has a function of detecting the position of the paddle 371. In detail, the detection unit 375 is composed of a diffuse reflection type optical sensor 376 and a light blocking plate 377. The diffuse reflection type optical sensor 376 has a light projection part for projecting light and a light receiving part for detecting light. The light blocking plate 377 is fixed to the shaft 374 and is rotated by the driving unit 373. Consequently, the diffuse reflection type optical sensor 376 can detect the rotational position of the light blocking plate 377 by projecting light to the light blocking plate 377 and detecting reflected light from the light blocking plate 377.

On the other hand, since the light blocking plate 377 is fixed to the shaft 374 of the driving unit 373 as the paddle 371, the rotational position of the light blocking plate 377 has a correspondence relation with the rotational position of the paddle 371. That is, the detection unit 375 can detect the position of the paddle 371 by detecting the rotational position of the light blocking plate 377 with the diffuse reflection type optical sensor 376. In addition, the configuration of the detection unit 375 is not limited to the configuration using the diffuse reflection type optical sensor as described above. That is, it is possible to employ a configuration of detecting the position of the paddle 371 by using various well-known types of sensors.

The control unit 310 controls the paddle 371 such that the front end portion 371A is positioned at the retreat position $P_R$ apart from the pressing member 363, during the approaching operation in which the pressing member 363 is approaching the paper bundle 20. That is, the determination control part determines whether the pressing member 363 is performing the approaching operation for approaching the paper bundle 20, and the retreat control part controls the removal member 370 such that the front end portion 371A is positioned at the retreat position apart from the pressing member 363 when the determination control part determines that the pressing member 363 is performing the approaching operation for approaching the paper bundle 20. Consequently, the paddle 371 is not caught between the paper bundle 20 and the pressing member 363, so that it is possible to prevent the paddle 371 from being damaged. Furthermore, even though the receiving block 364 is disposed in the vicinity of the cutting blade 368, the paddle 371 is prevented from being further damaged by the cutting blade 368. Furthermore, since the paddle 371 is rotated, the paddle 371 can be easily positioned at the retreat position $P_R$. For example, it is possible to more securely remove the cutting waste of the paper bundle by the front end portion 371A by stopping the rotation of the paddle 371 at the retreat position $P_R$ during the approaching operation in which the pressing member 363 is approaching the paper bundle 20, and starting the rotation operation for removing the cutting waste of the paper bundle 20 after the completion of the approaching operation.

It is preferable to rotate the paddle 371 a plurality of times such that the cutting waste of the paper bundle 20 is repeatedly removed by the front end portion 371A, and in this way, the cutting waste can be more securely removed.

The positioning to the retreat position $P_R$ is performed based on the rotational position of the paddle 371 (the rotational position of the light blocking plate 377) detected by the detection unit 375. Consequently, the paddle 371 can be high accurately positioned at the retreat position $P_R$.

It is preferable, when the paddle 371 is positioned at the retreat position $P_R$, to set the retreat position $P_R$ such that the paddle 371 does not interfere with component parts (e.g. the cutting mechanism 367) disposed in the vicinity of the paddle 371. In this case, it is possible to prevent the paddle 371 from being deformed (bent) by interference with the peripheral parts even though stop at the retreat position $P_R$ is repeated, The guide members 380, 381 and 382 are used for guiding the cutting waste toward the cutting waste discharge port 362. It is preferable to use, as the guide members 380, 381 and 382, a member obtained by forming a resin material containing an electrically conducting material into a sheet shape as a measure to static electricity. The resin material, for example, is polyamide resin, polyvinylchloride resin (PVC), polyethylene-terephthalate resin (PET), or polycarbonate resin. The electrically conducting material, for example, is carbon, metal, or metal oxide. In addition, in subsequent drawings after FIG. 6, for the purpose of simplification of drawings, the guide members 380, 381 and 382 are not shown.

Next, an operation of the cutting unit 360 will be described.

Figure 8:
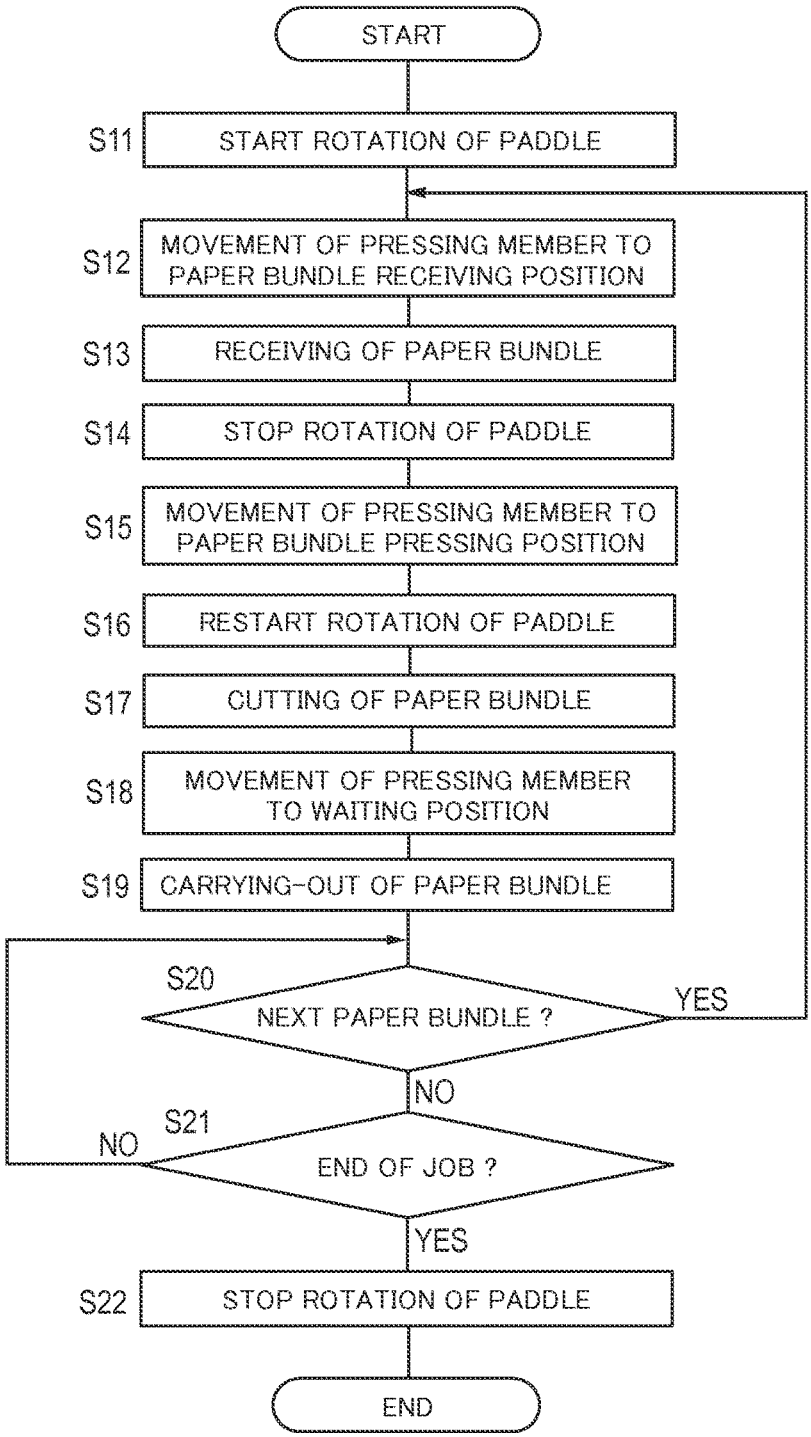
FIG. 8 is a flowchart of assistance in explaining an operation of the cutting unit.

FIG. 8 is a flowchart of assistance in explaining the operation of the cutting unit 360. FIG. 9, FIG. 10, FIG. 11, and FIG. 12 are schematic views of assistance in explaining the receiving of the paper bundle 20 in step S13, the movement of the pressing member 363 to the paper bundle pressing position $P_P$ in step S15, the cutting of the paper bundle 20 in step S17, and the carrying-out of the paper bundle 20 in step S19 shown in FIG. 8, respectively. In addition, an algorithm indicated by the flowchart shown in FIG. 8 is stored in the storage unit 320 as the cutting program 324 and is executed by the control unit 310.

Figure 9:
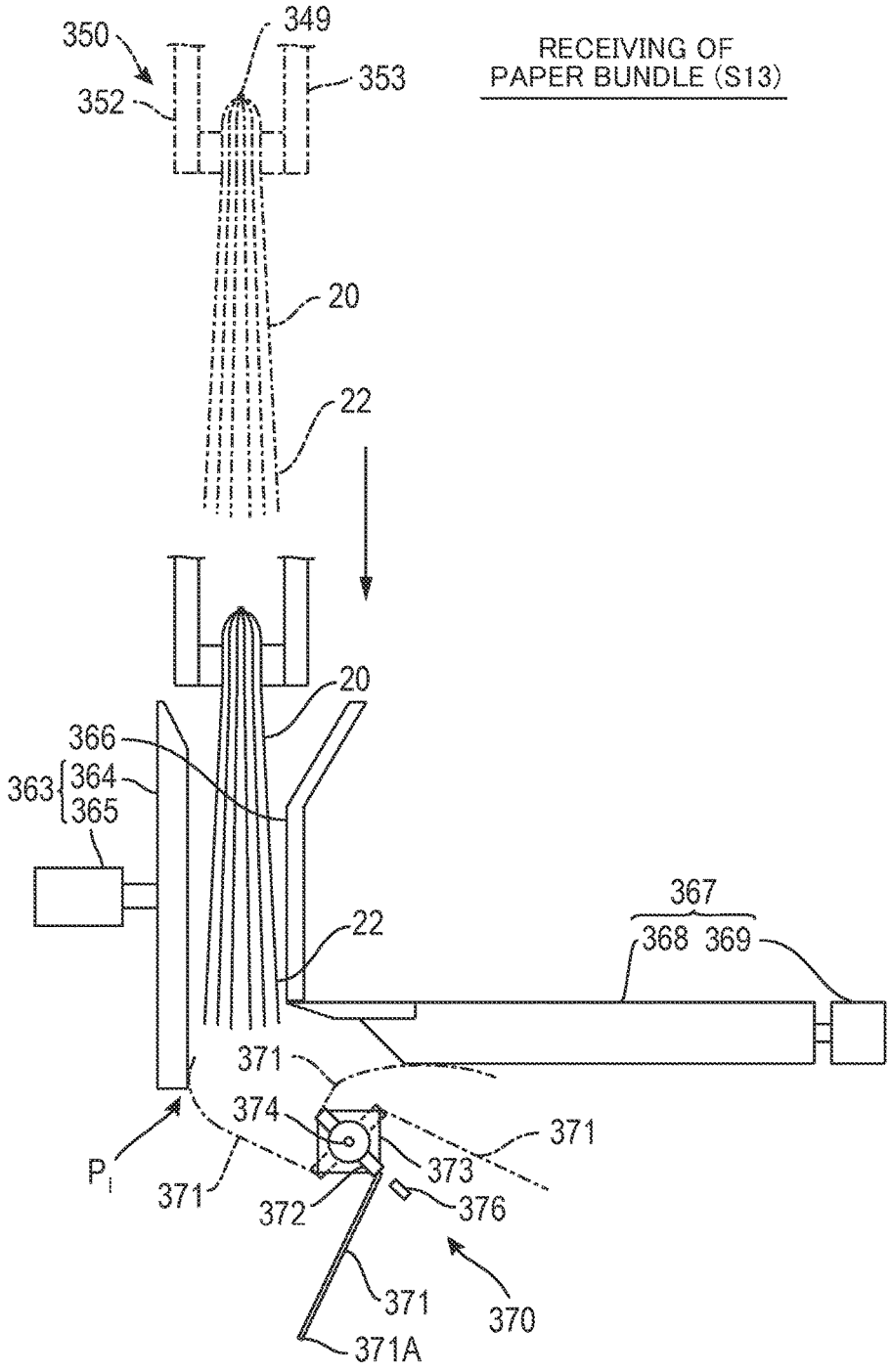
FIG. 9 is a schematic view of assistance in explaining the receiving of a paper bundle in step S13 shown in FIG. 9.

Firstly, when a post-processing job (a cutting job) is received, rotating the paddle 371 is started by the driving unit 373 (step S11), and the receiving block 364 is positioned at the paper bundle receiving position $P_1$ by the driving unit 365 (step S12). Then, as shown in FIG. 9, the arms 352 and 353 of the paper bundle conveying unit 350 move downward, so that the paper bundle 20 held by the arms 352 and 353 is inserted into a space formed between the pressing member 363 and the support member 366 through the paper bundle insertion port 361 (see FIG. 5) (step S13).

Figure 10:
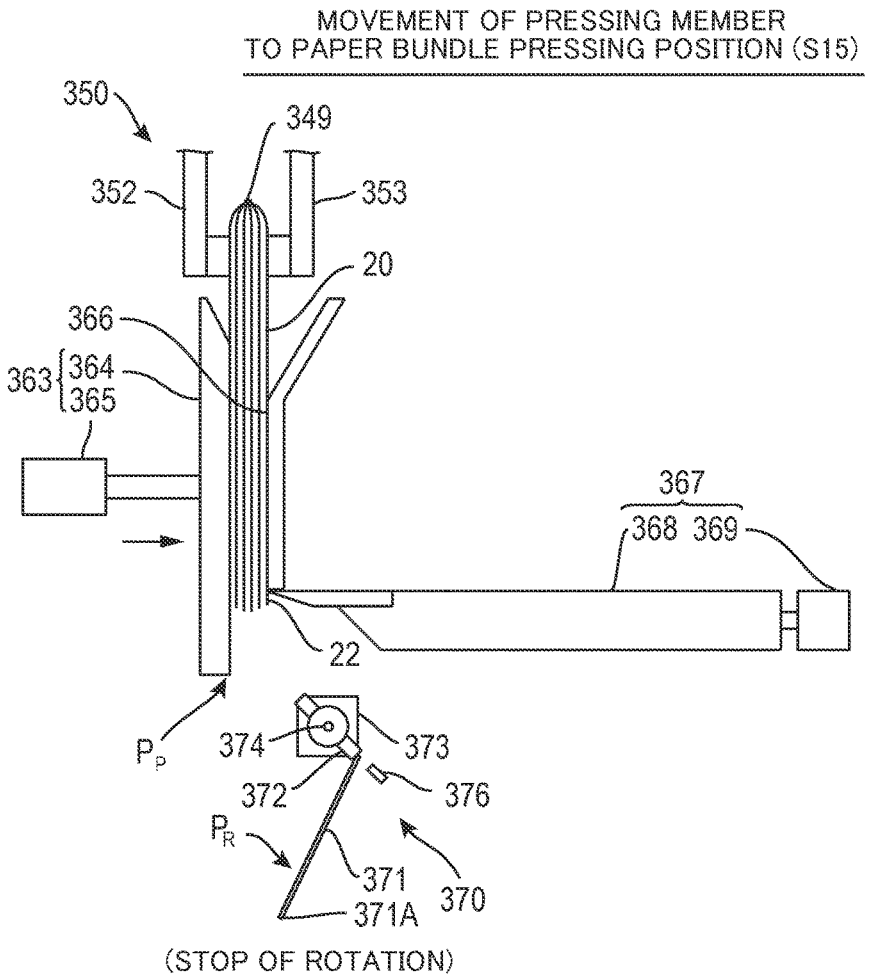
FIG. 10 is a schematic view of assistance in explaining the movement of a receiving block to a paper bundle pressing position $P_P$ in step S15 shown in FIG. 9.

Thereafter, rotating the paddle 371 is stopped and the paddle 371 is positioned to the retreat position $P_R$ (step S14). Then, as shown in FIG. 10, the pressing member 363 is driven by the driving unit 365, moves to the paper bundle pressing position $P_P$, and presses the paper bundle 20 (step S15).

As described above, the paddle 371 is positioned at the retreat position $P_R$ at which the front end portion 371A is apart from the pressing member 363, during the approaching operation in which the pressing member 363 is approaching the paper bundle 20. That is, the determination control part determines whether the pressing member 363 is performing the approaching operation for approaching the paper bundle 20, and the retreat control part controls the removal member 370 such that the front end portion 371A is positioned at the retreat position apart from the pressing member 363 when the determination control part determines that the pressing member 363 is performing the approaching operation for approaching the paper bundle 20. Consequently, the paddle 371 is not caught between the paper bundle 20 and the pressing member 363, so that it is possible to prevent the paddle 371 from being damaged. Furthermore, the paddle 371 is prevented from being further damaged by the cutting blade 368 even though the receiving block 364 is disposed in the vicinity of the cutting blade 368. In addition, since the paddle 371 is performing the rotation operation for removing the cutting waste of the paper bundle 20 from a time before the insertion of the paper bundle 20 into the space between the support member 366 and the pressing member 363 to a time before the start of the approaching operation of the pressing member 363, the cutting waste is removed before the start of the approaching operation of the pressing member 363 according to a current job even though cutting waste of a previous job remains, so that a bad influence on the current job is excluded.

Then, when the probability that the front end portion 371A of the paddle 371 is caught between the paper bundle 20 and the pressing member 363 is excluded by pressing and restraining the paper bundle 20 (after the completion of the approaching operation of the pressing member 363 and before the cutting of the end portion 22 of the paper bundle 20 by the cutting blade 368), the rotation of the paddle 371 is restarted (step S16).

Figure 11:
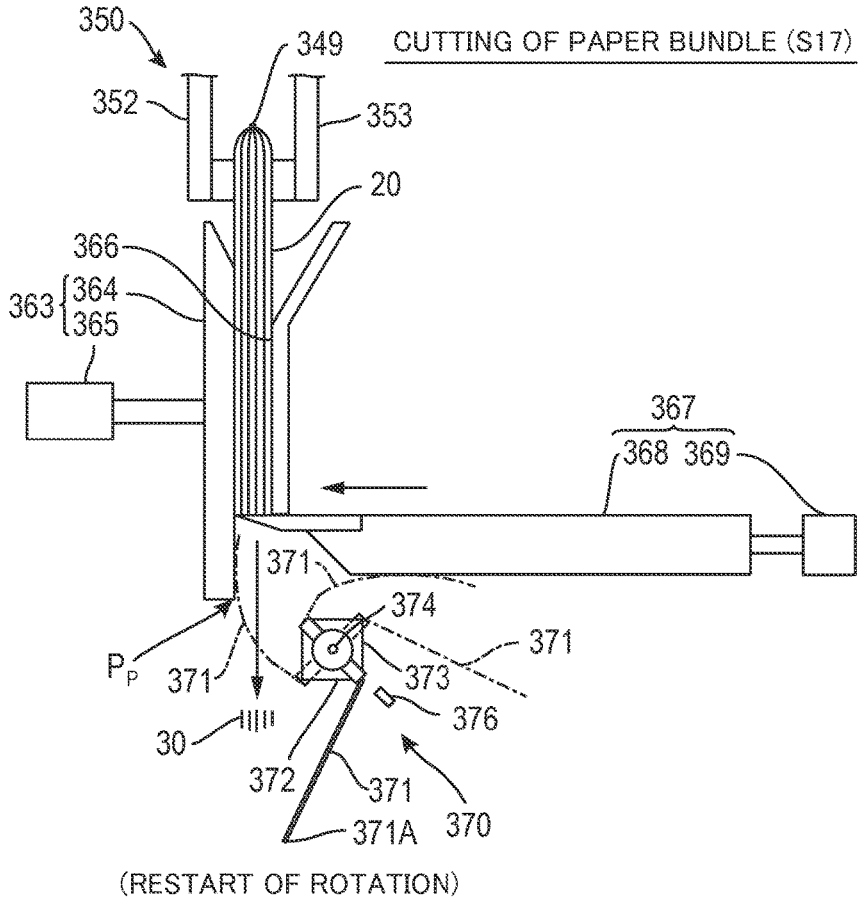
FIG. 11 is a schematic view of assistance in explaining the cutting of the paper bundle in step S17 shown in FIG. 9.
Figure 12:
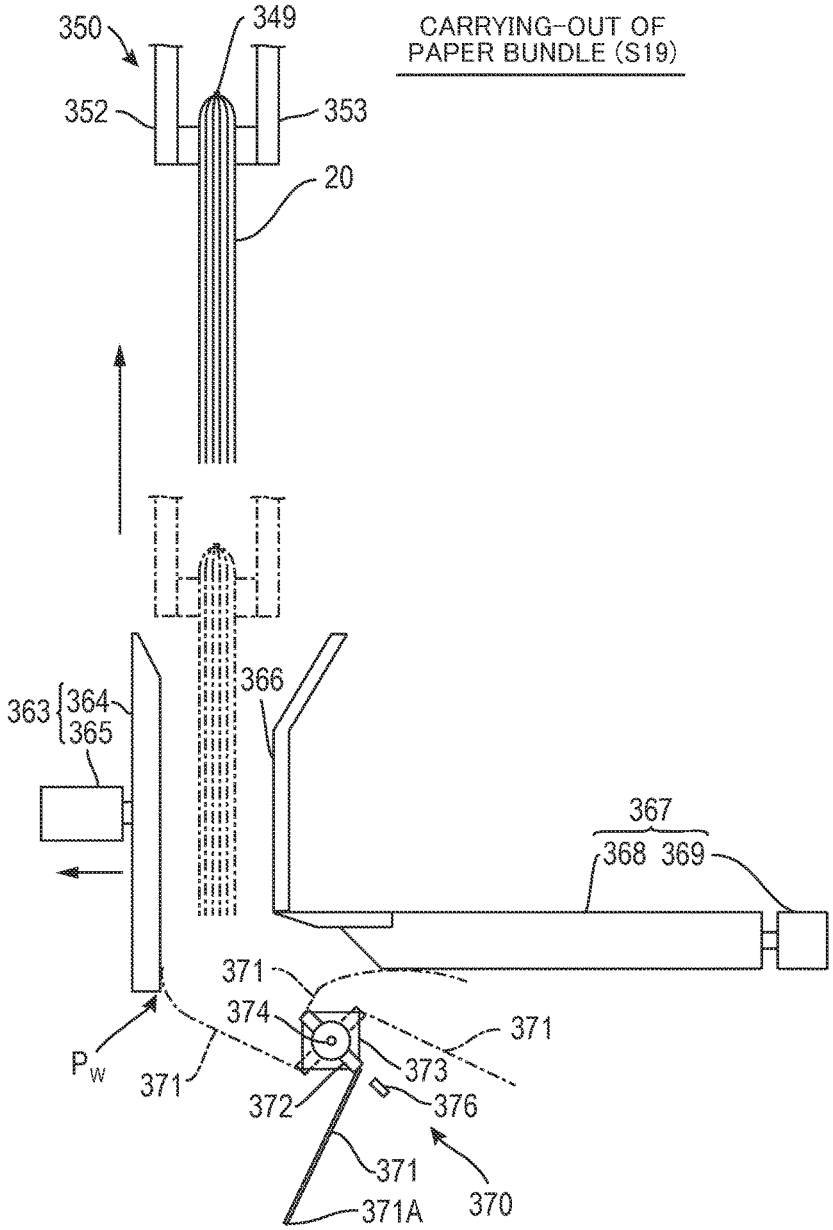
FIG. 12 is a schematic view of assistance in explaining the carrying-out of the paper bundle in step S19 shown in FIG. 9.

Next, as shown in FIG. 11, the cutting blade 368 is driven by the driving unit 369 toward the paper bundle 20 and cuts the end portion 22 of the paper bundle 20 (step S17). At this time, since the paddle 371 is rotated, the cutting waste 30 generated during the cutting is efficiently removed.

On the other hand, the cutting waste 30 of the bundle 20, which is removed by the paddle 371 or moves downward by its own weight, is guided by the guide members 380, 381 and 382, and is stored inside the cutting waste receiving unit 385 through the cutting waste discharge port 362 and the cutting waste receiving port 387 of the cutting waste receiving unit 385 (see FIG. 5).

Then, the receiving block 364 is driven by the driving unit 365, moves to the waiting position $P_W$, and the pressing (restraint) of the paper bundle 20 is released (step S18) and, as shown in FIG. 11, the arms 352 and 353 of the paper bundle conveying unit 350 move upward, so that the paper bundle 20 held by the arms 352 and 353 is taken out from the cutting unit 360 and is conveyed toward the paper discharge unit (step S19).

Thereafter, it is determined whether there is a next paper bundle 20 (step S20). When the next paper bundle 20 exists (step S20: YES), the process advances to step S12 and the aforementioned steps are repeated.

When there is no next paper bundle 20 (step S20: NO), it is determined whether the post-processing job (the cutting job) is ended (step S21). When the post-processing job is not ended (step S21: NO), the process advances to step S20 and the aforementioned steps are repeated. When the post-processing job is ended (step S21: YES), rotating the paddle 371 is stopped (step S22) and the process is ended.

As described above, in accordance with the paper processing apparatus (the paper post-processing apparatus) and the image forming system according to the present embodiment, since the removal member has a front end portion which may reach a position at which a paper bundle is pressed by the pressing member, cutting waste attached to the pressing member is securely removed. Furthermore, since the control unit controls the removal member such that the front end portion is positioned at the retreat position apart from the pressing member during the approaching operation in which the pressing member is approaching the paper bundle, the removal member is not caught between the paper bundle the pressing member. Consequently, it is possible to provide the paper processing apparatus and the image forming system which can securely remove cutting waste of the paper bundle and prevent the removal member from being damaged.

The present invention is not limited to the above embodiment, but can be modified in various forms within the range of the claims. For example, a paper bundle cut by the cutting blade is not limited to a saddle-stitched paper bundle. Furthermore, an end portion of the paper bundle cut by the cutting blade is not limited to an edge of the paper bundle. That is, the present invention can also be applied to the case of cutting the top and bottom of the paper bundle. Moreover, an image forming apparatus included in the image forming system can also be configured by MFP (Multi-Function Peripheral). Furthermore, the configuration of the removal member 370 is not limited to the rotary paddle type as described above, and it may be possible to employ a rotary brush type configuration for removing cutting waste by a rotating brush or a blade type configuration for removing cutting waste by a blade.

What is claimed is:

1. A paper processing apparatus comprising:

a supporting member for supporting a paper;

a pressing member which is disposed to form a space between said pressing member and said supporting member, and approaches and presses a paper bundle inserted into the space;

a cutting blade which cuts an end portion of the paper bundle pressed by said pressing member;

a removal member having a front end portion that is movable by a drive to contact the pressing member, when the pressing member is in a position at which the paper bundle is pressed by said pressing member, and remove cutting waste of the paper bundle on the pressing member, the removal member being rotatable by the drive so that the front end portion moves from the cutting blade toward the pressing member to remove the cutting waste; and a control unit which controls at least said drive of said removal member, wherein said control unit controls said drive of said removal member such that the front end portion is positioned at a retreat position apart from said pressing member during an approaching operation in which said pressing member is approaching the paper bundle.

2. The paper processing apparatus as claimed in claim 1, wherein said removal member is a paddle which is rotated.

3. The paper processing apparatus as claimed in claim 2, wherein said control unit controls said removal member to start an operation for removing the cutting waste of the paper bundle after completion of the approaching operation of said pressing member and before cutting of the end portion of the paper bundle by said cutting blade.

4. The paper processing apparatus as claimed in claim 2, wherein the paddle is rotatable to brush cutting waste off of the pressing member.

5. The paper processing apparatus as claimed in claim 1, wherein said control unit controls said removal member to stop its operating at the retreat position during the approaching operation in which said pressing member approaches the paper bundle, and controls said removal member to start an operation for removing the cutting waste of the paper bundle after completion of the approaching operation of said pressing member.

6. The paper processing apparatus as claimed in claim 1, wherein said control unit controls said removal member such that the cutting waste of the paper bundle is repeatedly removed.

7. The paper processing apparatus as claimed in claim 1, wherein said control unit controls said removal member to perform an operation for removing the cutting waste of the paper bundle during a period from a time before insertion of the paper bundle into the space to a time before start of the approaching operation of said pressing member.

8. The paper processing apparatus as claimed in claim 1, further comprising a detection unit for detecting a position of said removal member, wherein said control unit controls said removal member to be positioned at the retreat position based on said detected position.

9. The paper processing apparatus as claimed in claim 1, further comprising a component part of the cutting blade disposed in a vicinity of said removal member, wherein said retreat position is set such that said removal member does not interfere with said component part of the cutting blade when said removal member is positioned at the retreat position.

10. The paper processing apparatus as claimed in claim 1, wherein said paper bundle is saddle-stitched, and the end portion of the paper bundle, which is cut by said cutting blade, is an edge of the paper bundle.

11. An image forming system comprising:

an image forming apparatus which forms an image on a paper; and a paper post-processing apparatus which performs post-processing on a paper bundle which is formed by stacking a plurality of papers on which an image is formed by said image forming apparatus, wherein said paper post-processing apparatus is composed of said paper processing apparatus as claimed in claim 1.

12. A paper processing apparatus comprising:

a supporting member for supporting a paper;

a pressing member which is disposed to form a space between said pressing member and said supporting member, and approaches and presses a paper bundle inserted into the space;

a cutting blade which cuts an end portion of the paper bundle pressed by said pressing member;

a removal member having a front end portion that is movable by a drive to contact the pressing member, when the pressing member is in a position at which the paper bundle is pressed by said pressing member, and remove cutting waste of the paper bundle on the pressing member, the removal member being rotatable by the drive so that the front end portion moves from the cutting blade toward the pressing member to remove the cutting waste;

a determination control part which determines whether said pressing member is performing an approaching operation for approaching the paper bundle; and a retreat control part which controls said drive of said removal member to position the front end portion of said removal member at a retreat position apart from said pressing member when said determination control part determines that said pressing member is performing the approaching operation for approaching the paper bundle.

13. A paper processing apparatus comprising:

a supporting member for supporting a paper;

a pressing member which is disposed to form a space between said pressing member and said supporting member, and approaches and presses a paper bundle inserted into the space;

a cutting blade which cuts an end portion of the paper bundle pressed by said pressing member;

a removal member having a front end portion that is movable by a drive to contact the pressing member, when the pressing member is in a position at which the paper bundle is pressed by said pressing member, and remove cutting waste of the paper bundle on the pressing member; and a control unit which controls at least said drive of said removal member, wherein said control unit controls said drive of said removal member such that the front end portion is positioned at a retreat position apart from said pressing member during an approaching operation in which said pressing member is approaching the paper bundle, and said control unit controls said removal member to perform an operation for removing the cutting waste of the paper bundle during a period from a time before insertion of the paper bundle into the space to a time before start of the approaching operation of said pressing member.

14. An image forming system comprising:

an image forming apparatus which forms an image on a paper; and a paper post-processing apparatus which performs post-processing on a paper bundle which is formed by stacking a plurality of papers on which an image is formed by said image forming apparatus, wherein said paper post-processing apparatus is composed of said paper processing apparatus as claimed in claim 13.

* * * * *